US008919981B2

(12) United States Patent
Wang et al.

(10) Patent No.: US 8,919,981 B2
(45) Date of Patent: Dec. 30, 2014

(54) CUP WITH TWINKLING LIGHT EFFECTS

(71) Applicants: Connie Wang, Irvine, CA (US); Wei Hung Yu, New Taipei (TW)

(72) Inventors: Connie Wang, Irvine, CA (US); Wei Hung Yu, New Taipei (TW)

( * ) Notice: Subject to any disclaimer, the term of this patent is extended or adjusted under 35 U.S.C. 154(b) by 27 days.

(21) Appl. No.: 13/775,352

(22) Filed: Feb. 25, 2013

(65) Prior Publication Data

US 2014/0240962 A1 Aug. 28, 2014

(51) Int. Cl.
*F21V 33/00* (2006.01)
*A47G 23/02* (2006.01)

(52) U.S. Cl.
CPC ..... *A47G 23/02* (2013.01)
USPC ..... 362/101; 362/295

(58) Field of Classification Search
USPC ..... 362/101, 154, 646, 645, 300, 295
See application file for complete search history.

(56) References Cited

U.S. PATENT DOCUMENTS

| | | | | | |
|---|---|---|---|---|---|
| 2,224,319 | A * | 12/1940 | Schroyer | 362/101 |
| 2,663,866 | A * | 12/1953 | Simpson | 340/689 |
| 3,735,113 | A * | 5/1973 | Stott | 362/565 |
| 4,344,113 | A * | 8/1982 | Ditto et al. | 362/101 |
| 5,010,461 | A * | 4/1991 | Saotome | 362/101 |
| 5,624,177 | A * | 4/1997 | Rosaia | 362/101 |
| 6,443,589 | B1 * | 9/2002 | Lee | 362/101 |
| 6,591,524 | B1 * | 7/2003 | Lewis et al. | 40/324 |
| 6,793,362 | B2 * | 9/2004 | Tai | 362/101 |
| 6,921,179 | B2 * | 7/2005 | Diak Ghanem | 362/84 |
| 6,923,549 | B2 * | 8/2005 | Hoy | 362/101 |
| 6,955,443 | B2 * | 10/2005 | Solowiej | 362/101 |
| 7,018,062 | B2 * | 3/2006 | Taylor | 362/101 |
| 7,419,072 | B1 * | 9/2008 | Vanella | 222/113 |
| 7,458,698 | B2 * | 12/2008 | Heathcock et al. | 362/101 |
| D586,181 | S * | 2/2009 | Pola | D7/507 |
| 7,926,966 | B2 * | 4/2011 | Winters | 362/101 |
| 8,672,504 | B2 * | 3/2014 | Kramer | 362/154 |
| 2003/0147234 | A1 * | 8/2003 | Harada et al. | 362/84 |
| 2005/0207141 | A1 * | 9/2005 | Boesch et al. | 362/101 |

* cited by examiner

*Primary Examiner* — Ali Alavi
(74) *Attorney, Agent, or Firm* — Bacon & Thomas, PLLC

(57) ABSTRACT

This invention provides a cup with twinkling light effects, primarily comprising an inner cup, an outer cup, and a light unit, with the lower half of the inner cup having a number of arched convex strips, and the base of which has diamond-facet of concave and convex cones. As a result, when the light unit at the base of the outer cup is activated, the effects of the arched convex strips and diamond facets cause the cup to produce numerous refractions of the light source, creating twinkling rays of light with dazzling variation.

3 Claims, 5 Drawing Sheets

CUP WITH TWINKLING LIGHT EFFECTS

BACKGROUND OF THE INVENTION

1. Field of the Invention

This invention relates to a cup with twinkling light effects, particularly one in which arched convex strips on an inner cup and diamond facet of concave and convex cones at the base work to allow the cup not only to light up but to create twinkling rays of light with dazzling variation.

2. Description of the Prior Art

A cup generally refers to a vessel which may be filled with beverages for ease of drinking. There is currently a type of cup on the market that can light up; generally consisting of a single layer, such a cup cannot have patterns added to its textured surface. A lighting unit fit within the cup is activated when the user drinks the beverage in order to create a halo of light. However, as this illuminated cup only has a lighting unit in its base, it merely lights up, and cannot provide twinkling light. Typical double-walled cups do not light up, and the inner cup is typically comprised of a smooth cup body, which cannot produce a twinkling effect on light.

SUMMARY OF THE INVENTION

The main objective of this invention is to offer a cup in which the combination of the arched convex strips on an inner cup and diamond facet of concave and convex cones cause the light emitted by an illumination unit at the bottom of the cup to produce beams of light refracted at different angles with dazzling variations, creating a vivid, lively visual effect.

The main characteristics of the invention are an inner cup made of translucent material, the surface of which has arched convex strips and a base with diamond-facet of concave and convex cones; an outer cup made of translucent material which encases the outside of the inner cup, and which has an insert section at its base; a light unit, fit within the insert section, and which has a circuit board, lighting components, and a pressure switch.

BRIEF DESCRIPTION OF DRAWINGS

This invention is better understood by referring to the accompanying drawings, wherein.

DETAILED DESCRIPTION OF THE PREFERRED EMBODIMENT

Figure 1:
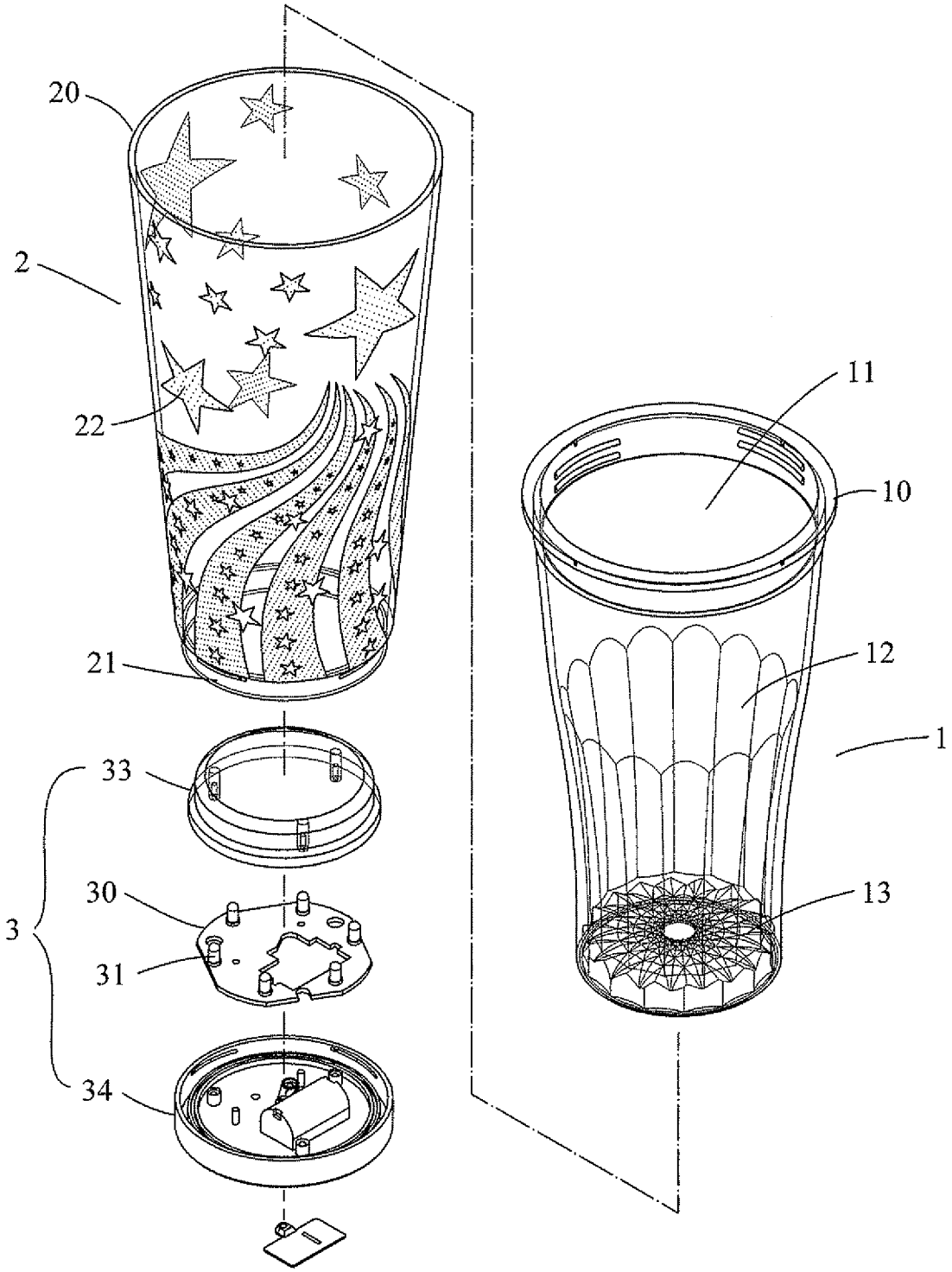
FIG. 1 is an exploded perspective view of the preferred embodiment of a cup with twinkling light effects in the present invention.
Figure 2:
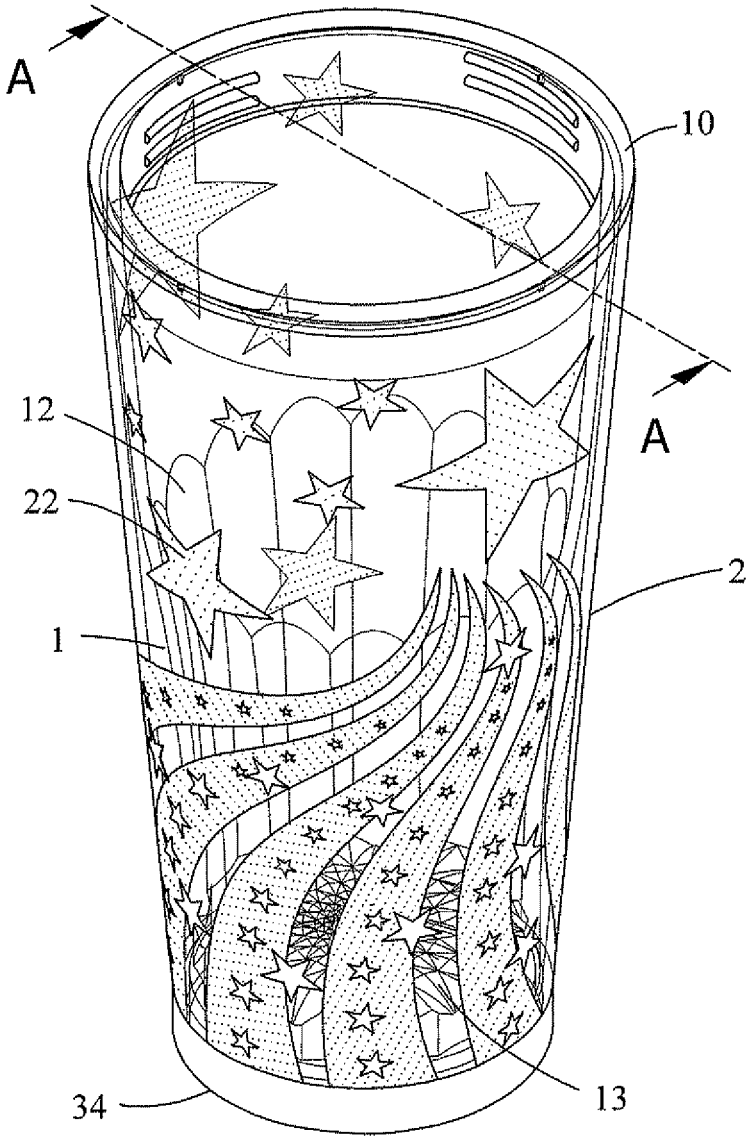
FIG. 2 is a perspective view of the preferred embodiment of a cup with twinkling light effects in the present invention.
Figure 3:
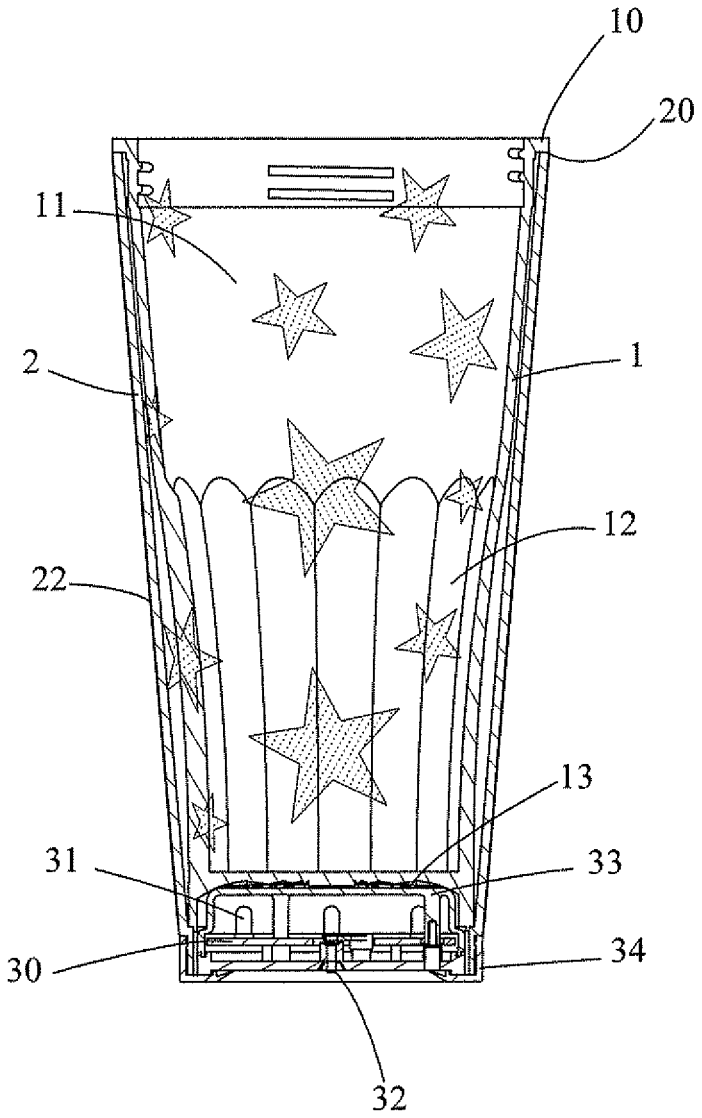
FIG. 3 is a cross sectional view, taken along line A-A of the cup with twinkling light effects of FIG. 2.
Figure 4:
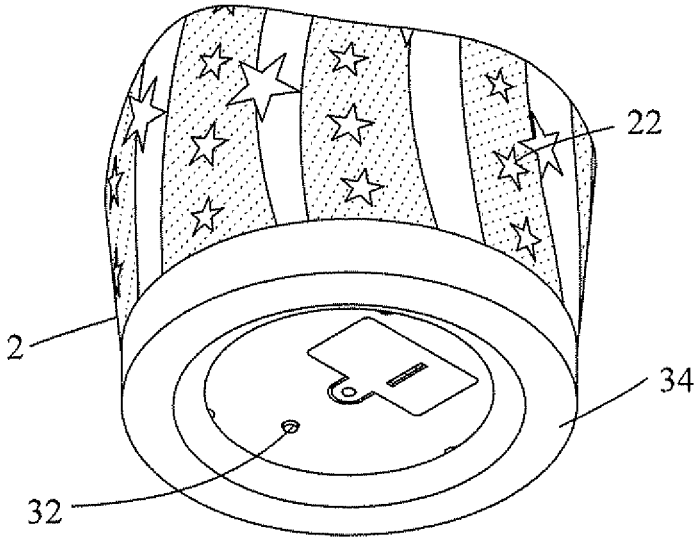
FIG. 4 is a bottom view of the preferred embodiment of FIG. 2.
Figure 5:
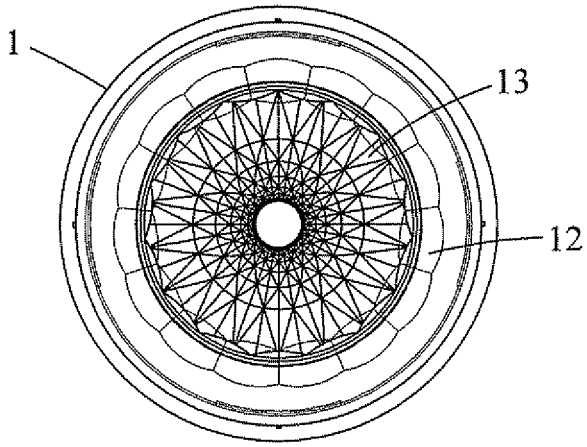
FIG. 5 is a bottom view of the preferred embodiment of the inner cup in the present invention.
Figure 6:
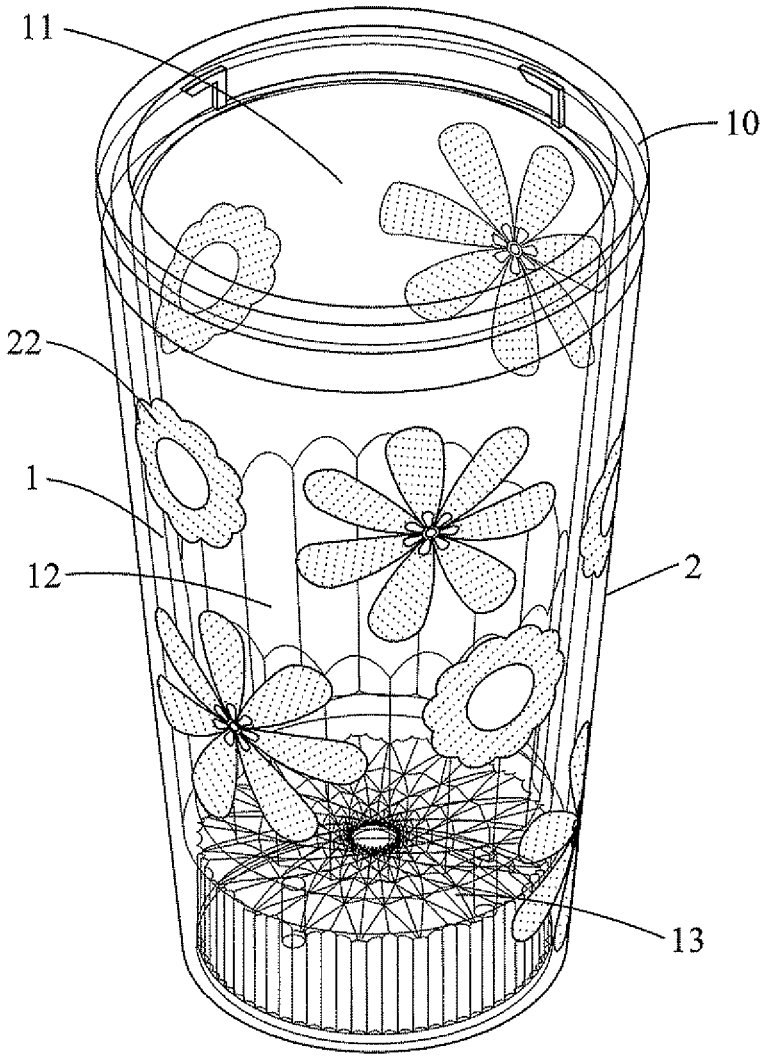
FIG. 6 is a perspective view of another actual embodiment of the cup with twinkling light effects in the present invention.

As shown in FIGS. 1 to 6, a preferred embodiment of a cup with twinkling light effects in the present invention includes an inner cup 1, an outer cup 2, and a light unit 3.

The inner cup 1 is made of translucent material. This inner cup 1 has a closure section 10 and chamber 11, while the lower half of the inner cup 1 has a number of arched convex strips 12. The walls of these arched convex strips 12 have the brightening effect of magnifying and diffusing light shone on them, while the base has diamond-facet of concave and convex cones 13. The concave and convex cones 13 are composed of numerous inclined planes of different angles, causing light shone on them to radiate outwards in a dazzling visual effect.

The outer cup 2 encases the outside of the inner cup 1. The outer cup 2 is made of translucent material. At the top of the outer cup is a closure surface 20, while at the base is an insert section 21. A sheet of printed film 22 can also be affixed to the walls of the outer cup 2 by means of heat transfer printing or roll printing, with the rays of light that shine on the printed film 22 producing an interactive twinkling effect.

The light unit 3 fits inside the insert section 21 of the outer cup 2. The light unit 3 is fitted with a circuit board 30, lighting components 31, a pressure switch 32, a transparent cover 33, and a base 34, wherein the lighting components 31 are comprised of one or more LED lights, and the circuit board 30 is designed with a light-changing circuit that can control the LED lights.

When assembling, the inner cup 1 is first inserted into the outer cup 2, and the parts are processed to combine them into a single unit, with the closure section 10 of the inner cup 1 in firm contact with the closure surface 20 of the outer cup 2. The light unit 3 is then inserted into the insert section 21 of the outer cup 2, completing assembly.

When using, prior to filling the chamber 11 of the inner cup 1 with liquid, the pressure switch 32 on the light unit 3 may be activated, causing the lighting components 31 to produce light. At this time, the varying light shining from the light components 31, due to the inner wall surface formed by the arched convex strips 12 and diamond-facet of concave and convex cones 13 at the base of the inner cup 1 on the inner cup 1, will not only provide illumination, but also produce twinkling light, which in combination with the liquid in the inner cup 1 creates a dazzling visual effect.

The invention has the following advantages as can be seen from the foresaid description.

1. The arched convex strips 12 and diamond-facet of concave and convex cones 13 on the invention's inner cup 1 can effectively increase the illumination from the light unit 3, making the twinkling light from the cup more dazzling.

2. After the invention's inner cup 1 is filled with liquid, it can multiply the twinkling effect of the twinkling light already being produced.

3. The arched convex strips 12 of different thicknesses around the invention's inner cup 1 can allow the light source to form rays of light, which work in conjunction with the printed film 22 on the outer cup to achieve a superior twinkling effect.

While the preferred embodiment of the invention has been described above, it will be recognized and understood that various modifications may be made therein and the appended claims are intended to cover all such modifications that may fall within the spirit and scope of the invention.

What is claimed is:

1. A cup with twinkling light effects, comprising:

an inner cup made of translucent material, the surface of which has arched convex strips and a base with diamond-facet of concave and convex cones;

an outer cup made of translucent material which encases the outside of the inner cup, and which has an insert section at its base;

a light unit, fit within the insert section, and which has a circuit board, lighting components, and a pressure switch;

which cup, through the combination of the above components can provide a cup with superior twinkling light effects.

2. A cup with twinkling light effects, comprising:

an inner cup made of translucent material, the surface of which has arched convex strips and a base with diamond-facet of concave and convex cones;

an outer cup made of translucent material which encases the outside of the inner cup, and which has an insert section at its base and a sheet of printed film applied to its outer walls;

a light unit, fit within the insert section, and which has a circuit board, lighting components, and a pressure switch.

3. The cup with twinkling light effect as claimed in claim 2, wherein said printed film can be affixed to the walls of the outer cup by means of heat transfer printing or roll printing, or may also be colored film or a thin plastic membrane inserted in the narrow space between the inner and outer cups.

* * * * *